US009446875B1

(12) United States Patent
Manuel

(10) Patent No.: US 9,446,875 B1
(45) Date of Patent: Sep. 20, 2016

(54) SANDBAG FILLING APPARATUS

(71) Applicant: Michael Manuel, Schriever, LA (US)

(72) Inventor: Michael Manuel, Schriever, LA (US)

( * ) Notice: Subject to any disclaimer, the term of this patent is extended or adjusted under 35 U.S.C. 154(b) by 0 days.

(21) Appl. No.: 14/793,255

(22) Filed: Jul. 7, 2015

(51) Int. Cl.
*B65B 67/12* (2006.01)
*B65F 1/06* (2006.01)

(52) U.S. Cl.
CPC ..... *B65B 67/12* (2013.01); *B65B 67/1238* (2013.01); *B65F 1/06* (2013.01)

(58) Field of Classification Search
CPC .. B65B 67/12; B65B 67/1238; B65F 1/1415
USPC ..... 141/313–316, 390, 391, 369; 220/495.06; 248/97, 95, 101
See application file for complete search history.

(56) References Cited

U.S. PATENT DOCUMENTS 1,470,203 A * 10/1923 Stone ..... B67B 7/18 141/390
1,698,683 A * 1/1929 Reynolds ..... B65F 1/08 220/23.87
1,858,793 A * 5/1932 Reynolds ..... B65B 67/12 141/340
2,827,931 A * 3/1958 Melvin ..... F25D 25/005 141/316
6,109,002 A * 8/2000 McCabe ..... B65F 1/02 220/495.08
7,913,871 B2 * 3/2011 Fisher ..... B65F 1/06 220/495.06

* cited by examiner

*Primary Examiner* — Timothy L Maust
*Assistant Examiner* — Timothy P Kelly
(74) *Attorney, Agent, or Firm* — Gulf Coast Intellectual Property Group

(57) ABSTRACT

A sandbag filling apparatus that is operable to assist a single individual in the task of filling sandbag. The sandbag filling apparatus includes a body that is perpendicularly secured to a bottom support member. The body is cylindrical in shape and is hollow having an interior volume. The body further includes a first end and a second end having an opening at said first end. A handle member is secured to the exterior of the body. A body support member is centrally secured to the bottom support member and the second end of the body is surroundably mounted therearound. The body of the sandbag filling apparatus is manufactured to a height that allows a portion of a sandbag disposed therein to extend outward from the perimeter edge of the opening at the first end.

20 Claims, 1 Drawing Sheet

SANDBAG FILLING APPARATUS

PRIORITY UNDER 35 U.S.C SECTION 119(E) & 37 C.F.R. SECTION 1.78

This nonprovisional application claims priority based upon the following prior U.S. Provisional Patent Application entitled: Sandbag Filler, Application No. 62/022,139 filed Jul. 8, 2014, in the name of Michael Manuel, which is hereby incorporated by reference for all purposes.

FIELD OF THE INVENTION

The present invention relates generally to tools, more specifically but not by way of limitation, an apparatus that is operable to assist a user in the filling of a sandbag.

BACKGROUND

Sandbags are known in the art and are utilized for many tasks. It is common to utilize sandbags during rising flood waters wherein the sandbags are arranged in a vertical wall configuration so as to substantially prevent water from egressing into an area. Additionally sand bags are routinely used during construction projects to either provide an anchor for an item that needs to be weighted down or for the temporary blocking of sewer drain entries or the like.

While sandbags have proven worthwhile for numerous applications, the task of filling the sandbag is cumbersome and typically requires two people in order to facilitate the effective filling thereof. Most sandbags are manufactured from a burlap type material and require an individual to hold the sandbag in a vertical open position and then require another individual to shovel sand or other filler thereinto. This is both, time consuming and costly.

Accordingly, there is a need for a sandbag filling apparatus that is operable to assist in the filling of a sandbag such that a single individual can efficiently fill a sandbag.

SUMMARY OF THE INVENTION

It is the object of the present invention to provide a sandbag filling apparatus that is operable to facilitate with the assisting of filling a sandbag that includes a vertical body that is cylindrical in shape having a first end and a second end.

Another object of the present invention is to provide a sandbag filling apparatus that is operable to assist a single user in the filling of a sandbag wherein the body includes an exterior surface having a handle member secured thereto.

A further object of the present invention is to provide a sandbag filling apparatus that is operable to provide a means of filling a sandbag wherein the filling process requires only one person wherein the vertical body is secured to a bottom support member.

Still another object of the present invention is to provide a sandbag filling apparatus that functions to allow a single user to fill a sandbag wherein a body engagement member is superposed the bottom support member and function to receive the second end of the body therearound.

An additional object of the present invention is to provide a sandbag filling apparatus that is operable to assist in the filling of a sandbag by providing a structure enable a single user to fill the sandbag disposed therein that includes fasteners operable to secure the body engagement member to the body.

Yet a further object of the present invention is to provide a sandbag filling apparatus that includes stand members secured to the bottom surface of the bottom support member.

Another object of the present invention is to provide a sandbag filling apparatus that is manufactured from a lightweight durable material so as to promote easy handling thereof.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
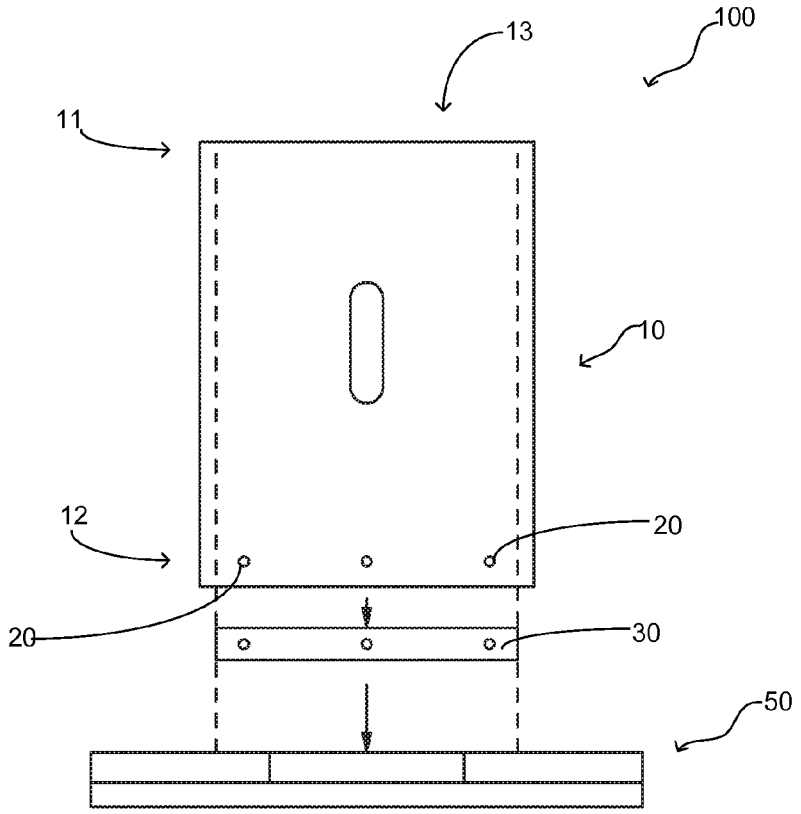
FIG. 1 is an exploded view of an embodiment of the present invention.
Figure 2:
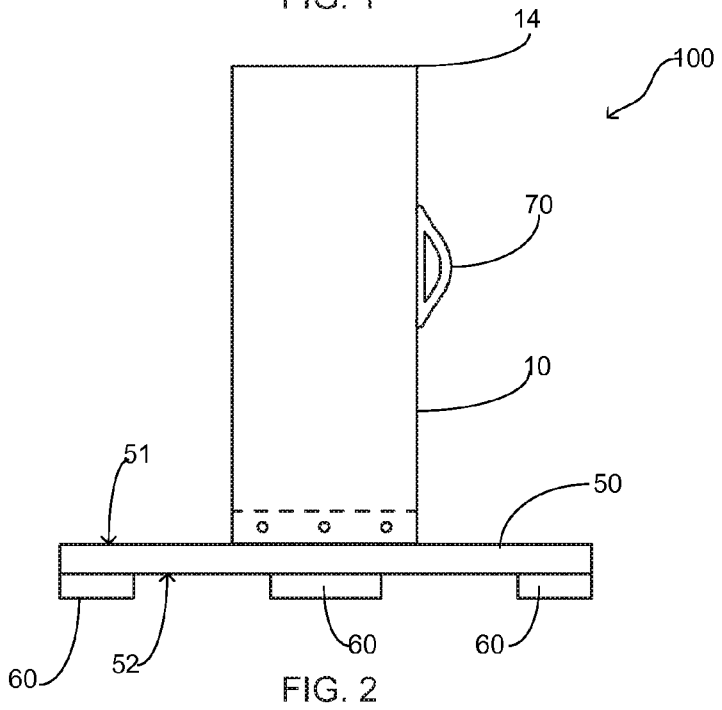
FIG. 2 is a perspective view of the preferred embodiment of the present invention.

Referring now to the drawings submitted herewith, wherein various elements depicted therein are not necessarily drawn to scale and wherein through the views and figures like elements are referenced with identical reference numerals, there is illustrated a sandbag filling apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures.

Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein the sandbag filling apparatus 100 further includes a body 10 that is cylindrical in shape having a first end 11 and a second end 12. The body 10 is manufactured from a suitable durable material such as but not limited to plastic and while not particularly illustrated herein is hollow having a passage intermediate the first end 11 and second end 12 creating an interior volume operable to receive a sandbag therein. The body 10 includes an opening 13 at first end 11 that functions to allow a user to place a sandbag into the interior volume of the body 10. The height of the body 10 is such that a conventional sandbag will extend slightly above the perimeter edge 14 so as to ensure while the sandbag is being filled, that it does not collapse into the interior volume and remains open for filling. While no particular size for the body 10 is required, good results have been achieved utilizing a body 10 that has an outer diameter of approximately eight inches. Furthermore, while no particular height is required for the body 10, it is desired for the preferred embodiment of the present invention that the body 10 is approximately twenty-two inches in height. Those skilled in the art will recognize that the body 10 could be manufactured in various different shapes and sizes and still accomplish the desired functionality described herein.

Still referring to FIG. 1 herein, the body 10 includes apertures 20 journaled therethrough proximate the second end 12. The second end 12 of the body 10 is secured to a body support member 30. The body support member 30 is mateably shaped to the body 10 so as to facilitate the coupling therewith. The body support member 30 provides the structure so as to ensure the maintenance of the integrity of the body 10 during the filling process of a sandbag. Additionally, the body support member 30 provides a technique to secure the body 10 to the bottom support member 50. Apertures 20 are operable to receive conventional fasteners therethrough such as but not limited to screws.

The body 10 is superposed the bottom support member 50 and is perpendicular thereto. The body support member 30 is secured to the upper surface 51 of the bottom support member utilizing suitable durable techniques such as but not limited mechanical or chemical techniques. The second end 12 of the body is surroundably mounted to the body support member 30 as previously discussed herein. The bottom support member 50 is square in shape and is operable to provide stability for the sandbag filling apparatus 100. It is contemplated within the scope of the present invention that the bottom support member 50 could be manufactured in various different sizes and shapes. While no particular size is required for the bottom support member 50, good results have been achieved utilizing a bottom support member 50 that is twenty inches by twenty inches. Secured to the bottom surface 52 utilizing suitable durable techniques are stand members 60. Stand member 60 provide a technique to elevate the bottom support member 50 and further provide improved stability of the sandbag filling apparatus 100. While three stand members 60 are illustrated in the embodiment herein, it is contemplated within the scope of the present invention that the sandbag filling apparatus 100 could have various quantities of stand members.

The body 10 further includes a handle member 70 secured to the exterior thereof. The handle member 70 provides a technique to grasp and transport the sandbag filling apparatus 100 and is manufactured from a suitable durable material. While one handle member 70 is illustrated herein, it is contemplated within the scope of the present invention that the body 10 could have more than one handle member 70 secured thereto.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A sandbag filling apparatus comprising:

a body, said body having a first end and a second end, said body having a wall, said wall being contiguously formed, said wall forming a cylindrical shape of said body, said body having an interior volume, said body having an opening proximate said first end; said body being positioned such that said first end is accessible to a user;

a bottom support member, said bottom support member being planar in manner and square in shape, said body being centrally positioned on said bottom support member;

a body support member, said body support member being secured to said bottom support member, said second end of said body surroundably mounting said body support member, said body support member being disposed within the interior volume of said body; and wherein the sandbag filling apparatus is operable to receive a sandbag into the interior volume thereof and have a portion thereof extend outward from said first end of said body.

2. The sandbag filling apparatus as recited in claim 1, and further including at least two stand members, said at least two stand members being secured to said bottom support member opposite said body, said at least two stand members providing elevational support for said bottom support member.

3. The sandbag filling apparatus as recited in claim 2, and further including a handle member, said handle member being secured to said body, said handle member providing an interface to transport and manipulate the sandbag filling apparatus.

4. The sandbag filling apparatus as recited in claim 3, wherein said body is cylindrical in shape and is approximately twenty-two inches in height.

5. The sandbag filling apparatus as recited in claim 4, wherein the body is manufactured from plastic and has an outer diameter of eight inches.

6. The sandbag filling apparatus as recited in claim 5, wherein the bottom support member is twenty inches by twenty inches.

7. The sandbag filling apparatus as recited in claim 6, and further including a plurality of apertures, said plurality of apertures being proximate said second end of said body, said plurality of apertures operable to receive fasteners therethrough to facilitate the securing of the body to the body support member.

8. A sandbag filling apparatus that is operable to facilitate the filling of a sandbag utilizing only one person comprising:

a body, said body being cylindrical in shape, said body having a first end and a second end, said body having an interior volume, said body having an interior surface, said body having an opening proximate said first end; said body being vertically positioned so as to provide access to the first end;

a bottom support member, said bottom support member being planar in manner and square in shape, said bottom support member being manufactured from a rigid material, said body being centrally positioned on said bottom support member;

a body support member, said body support member being secured to said bottom support member, said body support member being annular in shape, said body support member extending into said interior volume of said body, said body support member having an exterior surface, said exterior surface being perpendicular to said bottom support member, said exterior surface of said body support member configured to entirely engage the interior surface of said body, said second end of said body surroundably mounting said body support member; and wherein the sandbag filling apparatus is operable to receive a sandbag into the interior volume thereof and have a portion thereof extend outward from said first end of said body.

9. The sandbag filling apparatus as recited in claim 8, and further including a plurality of apertures, said plurality of apertures being proximate said second end of said body, said plurality of apertures operable to receive fasteners therethrough to facilitate the securing of the body to the body support member.

10. The sandbag filling apparatus as recited in claim 9, and further including a handle member, said handle member being secured to said body, said handle member providing an interface to transport and manipulate the sandbag filling apparatus.

11. The sandbag filling apparatus as recited in claim 10, wherein the bottom support member is twenty inches by twenty inches.

12. The sandbag filling apparatus as recited in claim 11, wherein the body is manufactured from plastic and has an outer diameter of eight inches.

13. The sandbag filling apparatus as recited in claim 12, wherein a sandbag disposed within said body extends beyond a perimeter edge of the opening of the first end.

14. The sandbag filling apparatus as recited in claim 13, and further including at least two stand members, said at least two stand members being secured to said bottom support member opposite said body, said at least two stand members providing elevational support for said bottom support member.

15. A sandbag filling apparatus that is operable to assist a single individual in the task of filling a sandbag comprising:

a body, said body having a wall, said wall being contiguously formed, said wall forming a cylindrical shape of said body, said body having a first end and a second end, said body having an interior volume, said body having an interior surface, said body having an opening proximate said first end; said body being vertically positioned so as to provide access to the first end;

a bottom support member, said bottom support member being planar in manner and square in shape, said bottom support member being manufactured from a rigid material, said body being centrally positioned on said bottom support member;

a body support member, said body support member being secured to said bottom support member, said body support member being annular in shape, said second end of said body surroundably mounting said body support member, said body support member extending into said interior volume of said body, said body support member having an exterior surface, said exterior surface being perpendicular to said bottom support member, said exterior surface of said body support member configured to entirely engage the interior surface of said body;

a plurality of apertures, said plurality of apertures being proximate said second end of said body, said plurality of apertures operable to receive fasteners therethrough to facilitate the securing of the body to the body support member; and wherein the sandbag filling apparatus is operable to receive a sandbag into the interior volume thereof and have a portion thereof extend outward from said first end of said body.

16. The sandbag filling apparatus as recited in claim 15, and further including at least two stand members, said at least two stand members being secured to said bottom support member opposite said body, said at least two stand members providing elevational support for said bottom support member.

17. The sandbag filling apparatus as recited in claim 16, and further including a handle member, said handle member being secured to said body, said handle member providing an interface to transport and manipulate the sandbag filling apparatus.

18. The sandbag filling apparatus as recited in claim 17, wherein the body is manufactured from plastic and has an outer diameter of eight inches.

19. The sandbag filling apparatus as recited in claim 18, wherein the bottom support member is twenty inches by twenty inches.

20. The sandbag filling apparatus as recited in claim 19, wherein a sandbag disposed within said body extends beyond a perimeter edge of the opening of the first end.

* * * * *